US010027021B2

(12) United States Patent
Jeong

(10) Patent No.: US 10,027,021 B2
(45) Date of Patent: Jul. 17, 2018

(54) THREE-DIMENSIONAL ANTENNA APPARATUS

(71) Applicant: HANSOL TECHNICS INC., Seoul (KR)

(72) Inventor: Yun-Hwa Jeong, Uiwang-si (KR)

(73) Assignee: HANSOL TECHNICS INC., Seoul (KR)

( * ) Notice: Subject to any disclaimer, the term of this patent is extended or adjusted under 35 U.S.C. 154(b) by 0 days.

(21) Appl. No.: 15/302,031

(22) PCT Filed: Dec. 23, 2014

(86) PCT No.: PCT/KR2014/012682

§ 371 (c)(1),
(2) Date: Oct. 5, 2016

(87) PCT Pub. No.: WO2015/182843

PCT Pub. Date: Dec. 3, 2015

(65) Prior Publication Data

US 2017/0125890 A1 May 4, 2017

(30) Foreign Application Priority Data

May 26, 2014 (KR) ..... 10-2014-0062955

(51) Int. Cl.
*H01Q 1/38* (2006.01)
*H01Q 1/24* (2006.01)

(52) U.S. Cl.
CPC ..... *H01Q 1/245* (2013.01); *H01Q 1/38* (2013.01)

(58) Field of Classification Search
CPC ..... H01Q 1/245; H01Q 1/38
See application file for complete search history.

(56) References Cited

U.S. PATENT DOCUMENTS

2006/0017628 A1* 1/2006 Wu ..... H01Q 1/36 343/702
2006/0033665 A1* 2/2006 Yang ..... H01Q 9/0414 343/700 MS
2006/0262030 A1 11/2006 Bae et al.
2007/0030202 A1 2/2007 Lee et al.

FOREIGN PATENT DOCUMENTS

CN 102683833 9/2012
EP 2926970 10/2015
JP 2013175583 9/2013

(Continued)

OTHER PUBLICATIONS

International Search Report—PCT/KR2014/012682 dated Jan. 16, 2015.

(Continued)

*Primary Examiner* — Graham Smith
(74) *Attorney, Agent, or Firm* — Cantor Colburn LLP

(57) ABSTRACT

Provided is a three-dimensional antenna apparatus formed through a curved substrate for a portable terminal, which can be implemented by a first antenna pattern formed on one side surface of the curved substrate, a second antenna pattern formed on the other side surface opposite to the one side surface of the curved substrate, and an antenna connection pattern electrically connecting the first antenna pattern and the second antenna pattern.

16 Claims, 7 Drawing Sheets

(56) References Cited

FOREIGN PATENT DOCUMENTS

| | | |
|---|---|---|
| KR | 1020060123597 | 12/2006 |
| KR | 1020130083763 | 7/2013 |
| KR | 101339015 | 12/2013 |
| WO | 2013172668 | 11/2013 |

OTHER PUBLICATIONS

PCT Written Opinion—PCT/KR2014/012682 dated Jan. 16, 2015, citing KR 10-1339015, KR 10-2013-0083763 and KR 10-2006-0123597.

European Search Report—European Application No. 14893014.2 dated Jan. 5, 2018, citing KR 101 339 015, WO 2013/172668, EP 2 926 970 and US 2006/262030.

Chinesee Office Action—Chinesee Application No. 201480077308.4 dated Apr. 4, 2018, citing CN 102683833, WO 2013/172668, KR 10-2013-0083763 and KR 101339015.

* cited by examiner

THREE-DIMENSIONAL ANTENNA APPARATUS

BACKGROUND

1. Field

Embodiments of the present invention relate to a three-dimensional antenna apparatus formed through a curved substrate.

2. Description of Related Art

A portable terminal is becoming one of the most essential electronic equipments. Particularly, mobile communication terminals directed for the purpose of speech or video phone among the portable terminals have been making rapid development, and are fast evolving to produce the type of smart phones available up to internet communication.

The technology of a portable terminal is being advanced to reduce the size of volume or weight of rest modules except for a display in order to provide its unique purpose of portability. The portable terminal may provide function as speech phone or video phone, and an antenna is an essential element for such a speech phone or video phone.

An antenna used for communication portable terminal has been developed from an external antenna which is not embedded inside a portable terminal but located outside a portable terminal in order to enhance the portability purpose and reduce the rate for breakage to an internal antenna which is embedded inside a portable terminal. The internal antenna has been developed to operate in from one frequency band to two or more frequency bands, that is, multiple frequency bands, and is being developed to reduce the antenna mounting space.

SUMMARY

Embodiments of the present invention provide a three-dimensional antenna apparatus widely used for various portable apparatus such as mobile phone by effectively using the curved-shaped one side of the housing of such mobile thereby increasing the space efficiency of such portable terminals.

Other embodiments of the present invention provide a three-dimensional antenna apparatus sufficiently implemented by using a curved-shaped printed circuit board (PCB) itself without independent mold cast for antenna emitter thereby shortening the development lead time.

Other embodiments of the present invention provide a method of fabricating a three-dimensional antenna apparatus for employing relatively simple processing such as patterning and drilling thereby reducing fabrication expenses and decreasing processing failures which may be often caused from such as metallization and injection.

In accordance with an aspect of the present invention, the three-dimensional antenna apparatus may include a curved substrate, a first antenna pattern formed on one side surface of the curved substrate, a second antenna pattern formed on the other side surface opposite to one side surface of the curved substrate, and an antenna connection pattern electrically connecting the first antenna pattern and the second antenna pattern.

The three-dimensional antenna apparatus according to an embodiment of the present invention may include the first antenna pattern and the second antenna pattern which are distanced apart from each other with a predetermined interval.

The connection pattern according to an embodiment of the present invention may penetrate at least a part of the curved substrate.

The curved substrate according to an embodiment of the present invention may be a rigid substrate formed by a mold cast.

The rigid substrate according to an embodiment of the present invention may include at least either one among FR4 and FRP.

The three-dimensional antenna apparatus according to an embodiment of the present invention may further include an external element made of a conductive material, and the external element can be electrically connected with at least one of the first antenna pattern and the second antenna pattern.

The three-dimensional antenna apparatus according to an embodiment of the present invention may further include a coupling unit for coupling the curved substrate and the housing of a portable terminal.

The coupling unit according to an embodiment of the present invention may further include an embossing with the shape corresponding to another embossing formed on one side surface of the housing of the portable terminal, and the curved substrate and the housing of the portable terminal can be coupled with each other by joining the embossing of the coupling unit and the embossing of the housing of the portable terminal.

The coupling unit according to an embodiment of the present invention may include an adhesive film, and the adhesive film may couple the curved substrate and the housing of the portable terminal together there between.

The coupling unit according to an embodiment of the present invention may include a screw which is about to penetrate the curved substrate and the housing of the portable terminal, and the curved substrate and the housing of the portable terminal can be coupled with each other by fastening the screw there through.

The coupling unit according to an embodiment of the present invention may couple the curved substrate and the housing of the portable terminal together by the way of melt welding.

The coupling unit according to an embodiment of the present invention may couple the curved substrate and the housing of the portable terminal together by the way of insert injection.

In accordance with another aspect of the present invention, a method of fabricating a three-dimensional antenna apparatus according to an embodiment of the present invention may include performing drilling on a curved substrate so as to form a hole, applying a conductive material on the hole and one side surface of the curved substrate and the other opposite side surface thereof, and etching the one side surface of the curved substrate and the other opposite side surface thereof for antenna patterning.

The conductive material applied to the hole may form a connection pattern which is to penetrate at least a part of the curved substrate, and the patterning for antenna formed on the one side surface of the curved substrate and the other opposite side surface thereof may be electrically connected with each other by the connection pattern.

Therefore, according to the present invention, the curved side surface of a portable terminal housing can be used as an antenna in three dimension, thereby increase the space efficiency occupied by components and employed necessarily in a portable terminal.

Therefore, the three-dimensional antenna according to the present invention does not need a separate mold case for antenna emitter and can be implemented just by a printed circuit board (PCB), thereby shorten the development lead time.

Therefore, the three-dimensional antenna according to the present invention may be fabricated by using just simple processes such as patterning and drilling, thereby incredibly decrease failures in the metallization and injection processes.

BRIEF DESCRIPTION OF THE DRAWINGS

The foregoing and other features and advantages of the present inventions will be apparent from the more particular description of preferred embodiments of the present inventions, as illustrated in the accompanying drawings in which like reference characters refer to the same parts throughout the different views. The drawings are not necessarily to scale, emphasis instead being placed upon illustrating the principles of the present inventions. In the drawings.

DETAILED DESCRIPTION OF THE EMBODIMENTS

Figure 1:
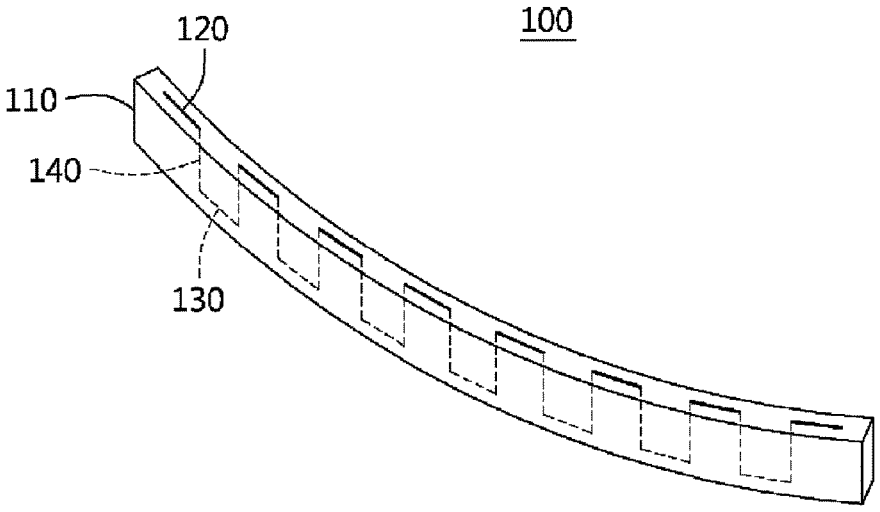
FIG. 1 is a view illustrating a three-dimensional antenna apparatus according to an embodiment of the present invention.

Since exemplary embodiments of the present invention are provided only for structural and functional descriptions of the present invention, the present invention should not be construed as limited to the embodiments set forth herein. Thus, it will be clearly understood by those skilled in the art that the exemplary embodiments of the present invention may be embodied in different forms and include equivalents that can realize the spirit of the present invention. It should be understood, however, that it is not intended to limit the present invention to the particular forms disclosed, but on the contrary, the present invention is to cover all modifications, equivalents, and alternatives falling within the spirit and scope of the present invention as defined by the appended claims.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

It will be understood that when an element or a component layer is referred to as being "connected to" or "coupled to" or "jointed to" another element or layer, it can be directly connected or coupled to the other element or layer or intervening elements or layers may be present. In contrast, when an element is referred to as being "directly connected to" or "directly coupled to" another element or layer, there are no intervening elements or layers present. Meanwhile, spatially relative terms, such as "between" and "directly between" or "adjacent to" and "directly adjacent to" and the like, which are used herein for ease of description to describe one element or feature's relationship to another element(s) or feature(s) as illustrated in the figures, should be interpreted similarly.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless expressly defined in a specific order herein, respective steps described in the present invention may be performed otherwise. That is, the respective steps may be performed in a specified order, substantially at the same time, or in reverse order.

The present invention will now be described more fully hereinafter with reference to the accompanying drawings, in which exemplary embodiments of the present invention are shown.

FIG. 1 is a view illustrating a three-dimensional antenna apparatus 100 according to an embodiment of the present invention.

The three-dimensional antenna apparatus 100 according to an embodiment of the present invention may include a curved substrate 110, a first antenna pattern 120 formed on one side surface of the curved substrate 110, a second antenna pattern 130 formed on the other side surface opposite to the one side surface, and an antenna connection pattern 140 of electrically connecting the first antenna pattern 120 and the second antenna pattern 130.

While antenna patterns were two-dimensionally formed only on one surface in typical antenna structures, the antenna apparatus 100 according to an embodiment of the present invention is formed three-dimensionally by adding a z-axis antenna pattern to the two-dimensional antenna patterns formed only on one side of a plane surface made by x-axis and y-axis.

For this purpose, the x-axis and y-axis may be taken by the first antenna pattern 120 or the second antenna pattern 130, and the z-axis may be formed by the antenna connection pattern 140.

The antenna patterns of x-axis and y-axis may not be necessarily formed only on one side surface of the substrate 110 with introduction of the z-axis antenna connection pattern 140. As the result of the addition, the first antenna pattern 120 and the second antenna pattern 130 may be respectively patterned on opposite two side surfaces facing each other in the three-dimensional antenna apparatus 100 according to an embodiment of the present invention. Further, the first antenna pattern 120 and the second antenna pattern 130 may be electrically connected to each other by the antenna connection pattern 140.

The first antenna pattern 120 and the second antenna pattern 130 may be formed with a predetermined interval distanced apart from each other. The first antenna pattern 120 and the second antenna pattern 130 may maintain the interval of 0.2 mm to 0.8 mm.

The antenna connection pattern 140 may be formed by a via, a hole, a via hole, or a through hole.

Meanwhile, the curved substrate 110 may be a rigid substrate formed by a mold cast.

Figure 2:
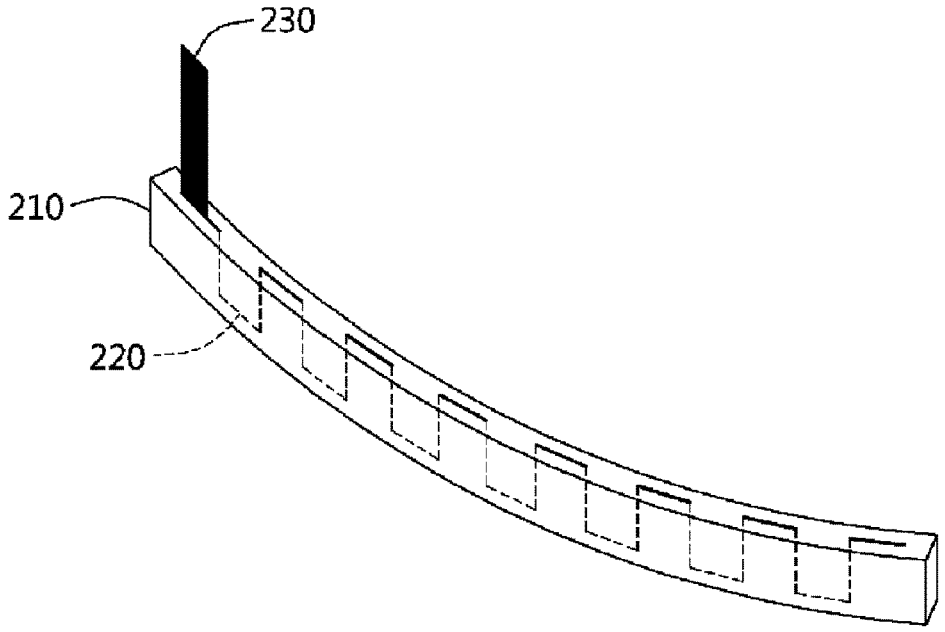
FIG. 2 is a view illustrating an external element of the three-dimensional antenna apparatus according to an embodiment of the present invention.

FIG. 2 is a view of an external element 230 of a three-dimensional antenna apparatus according to one embodiment of the present invention.

As illustrated in FIG. 2, a three-dimensional antenna apparatus 210 according to one embodiment of the present invention may be used as antenna for the produce such as a portable terminal. In order to achieve this purpose, the three-dimensional antenna apparatus 210 according to one embodiment of the present invention may be fabricated by further including an external element 230 made of a conductive material, or may include an inductor or capacitor element.

The external element 230 made of a conductive material may be electrically connected with at least either one of the first antenna pattern and the second antenna pattern.

The three-dimensional antenna apparatus 210 according to one embodiment of the present invention receives a wireless signal from other module of the portable terminal through the external element 230, and emits the signal to outside through an antenna 220. On the contrary, the three-dimensional antenna apparatus 210 according to an embodiment of the present invention may collect a wireless signal from outside through the antenna 220, and may deliver to other module of the portable terminal through the external element 230.

For another example, the external element 230 may be used as interface with other terminal interworking with the portable terminal for data transmission and receiving.

The portable terminal may be understood as a smart phone and the three-dimensional antenna apparatus 210 may be embedded inside the smart phone so as to function as antenna to transmit and receive voice data or communication data.

The three-dimensional antenna apparatus 210 according to an embodiment of the present invention may be formed as a three-dimensional antenna including antenna patterns formed on a curved substrate and a connection pattern formed through the curved substrate, and may be located on the curved side surface or the bottom surface of the smart phone.

With the structure formed as above, the curved side surface of the housing of the smart phone can be also well used for a three-dimensional antenna by using the three-dimensional antenna apparatus 210 according to an embodiment of the present invention in three dimensions so as to increase the space usage efficiency of the smart phone.

Figure 3:
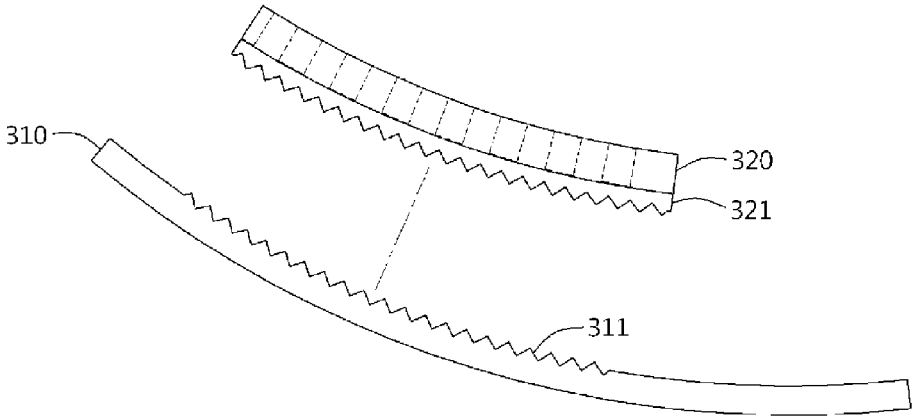
FIG. 3 is a view illustrating the uneven-shaped surfaces of a curved substrate of the antenna apparatus and a housing of a portable terminal, which are coupled with each other together thereby according to an embodiment of the present invention.

FIG. 3 is a view illustrating the uneven-shaped surfaces of a curved substrate 320 of an antenna apparatus and a housing 310 of a portable terminal, which are coupled together thereby according to one embodiment of the present invention.

The curved substrate 320 can be coupled with the housing 310 of a portable terminal, in which a coupling unit can be used in the curved substrate 320.

The coupling unit of the curved substrate 320 according to an embodiment of the present invention may include the surface formed with embossing. For example, the coupling unit according to an embodiment of the present invention may include an embossing surface which is processed and configured to correspond with and fit into the embossing surface formed on one facing surface of the housing of a smart phone. The curved substrate and the housing of the smart phone can be coupled with each other by using the way of melt welding to join together the embossing surface of the coupling unit and the embossing surface of the housing. Or, the curved substrate and the housing of the smart phone can be coupled with each other by using the way of insert.

As shown in FIG. 3, an embossing 321 can be formed on the side of the curved substrate 320 which will be coupled with the housing 310 of a portable terminal. Meanwhile, an embossing 311 can be formed on the housing 310 of a portable terminal with the shape to correspond to the embossing 321 of the curved substrate 320.

The curved substrate 320 can be coupled with the housing 310 of the smart phone by use of the both surfaces with the embossing 311 and 321 thereon.

Figure 4:
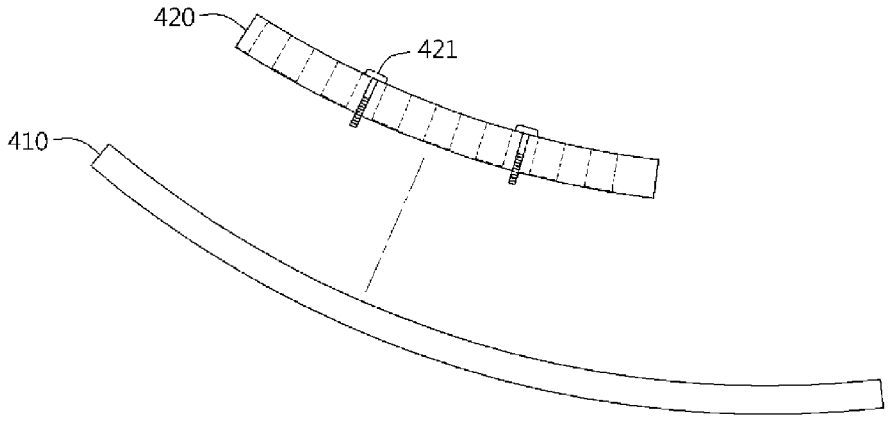
FIG. 4 is a view illustrating that a curved substrate of the antenna apparatus and a housing of a portable terminal are being jointed by using screws according to an embodiment of the present invention.

FIG. 4 is a view illustrating an embodiment of coupling a curved substrate and a housing of a portable terminal by the use of screws according to one embodiment of the present invention.

A curved substrate 420 can be coupled with a housing 410 of a portable terminal for which a coupling unit can be employed.

The coupling unit according to an embodiment of the present invention may include a screw 421. For example, the three-dimensional antenna apparatus according to one embodiment of the present invention may include the curved substrate 420 and the screw 421, which will go inside and penetrate a housing 410 of a portable terminal. When the screw 421 is fastened into the housing 410, so that the curved substrate 420 and the housing 410 of a portable terminal can be coupled with each other.

Figure 5:
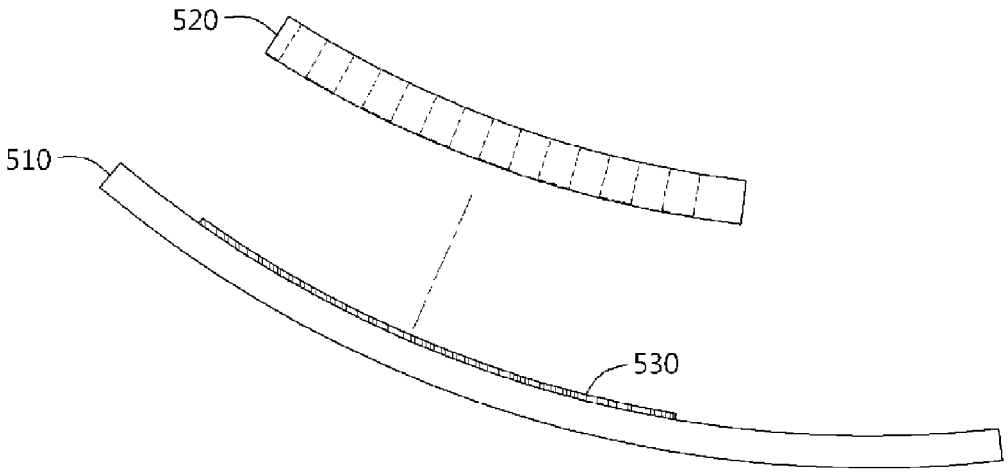
FIG. 5 is a view illustrating that a curved substrate of the antenna apparatus and a housing of a portable terminal are being jointed by using a film according to an embodiment of the present invention.

FIG. 5 is a view illustrating an embodiment of coupling a curved substrate and a housing of a portable terminal by use of a film according to one embodiment of the present invention.

A curved substrate 520 can be coupled with a housing 510 of a portable terminal for which a coupling unit can be employed.

The coupling unit according to an embodiment of the present invention may include an adhesive film 530. For example, the coupling unit according to one embodiment of the present invention includes the adhesive film 530, and the adhesive film 530 functions to couple the curved substrate 520 and the housing 510 of a portable terminal between the curved substrate 520 and the housing 510 of the portable terminal.

As another example, the coupling unit according to an embodiment of the present invention may use the melt welding method to couple the curved substrate and the housing of the portable terminal together. Or, the coupling unit according to another embodiment of the present invention may use the insert injection method to couple the curved substrate and the housing of the portable terminal together.

Figure 6:
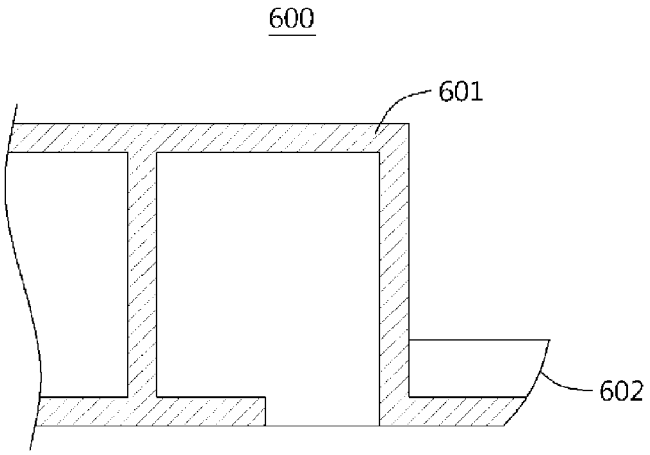
FIG. 6 is a top view of an antenna pattern according to an embodiment of the present invention.

FIG. 6 is a top view 600 illustrating an antenna pattern according to an embodiment of the present invention.

As shown in FIG. 6, an antenna pattern 601 according to an embodiment of the present invention can be patterned on one side surface of a curved substrate 602 and on the other opposite side surface thereof. The patterns respectively formed on one side surface and the other side surface of the curved substrate 602 can be electrically connected with each other through a connection pattern formed along a z-axis, that is, the direction penetrating the curved substrate 602 so as to create an antenna pattern in three-dimension.

With structured as above, the curved surface of a housing of a portable terminal can be used as antenna in three-dimension by using the three-dimensional antenna apparatus including the antenna pattern 601 according to an embodiment of the present invention thereby to highly increase the space usage efficiency of the portable terminal.

Figure 7:
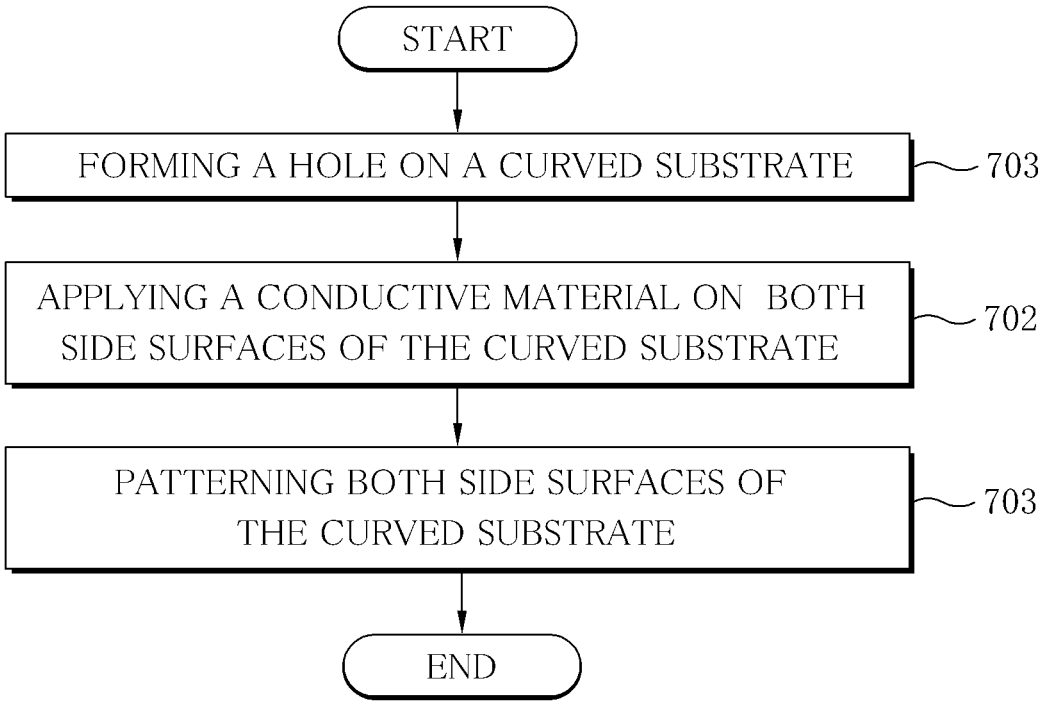
FIG. 7 is a view illustrating the processing of a method for fabricating a three-dimensional antenna apparatus according to an embodiment of the present invention.

FIG. 7 is a view to explain a method of fabricating a three-dimensional antenna apparatus according to one embodiment of the present invention.

The method of fabricating a three-dimensional antenna apparatus according to an embodiment of the present invention may include performing drilling on a curved substrate to form a hole (process 701). For convenience in this specification, the method of forming a hole by drilling is explained, but various methods of forming a via, a hole, a via hole, a through hole and so on can be also employed in the process 701.

The method of fabricating a three-dimensional antenna apparatus according to an embodiment of the present invention may include a process of forming a connection pattern by applying a conductive material on the hole formed as above. Or, a conductive material may be applied on one side surface of the curved substrate and on the other opposite side surface thereof. While considering one side surface of the curved substrate and the other opposite side surface thereof as x-axis and y-axis planes, the connection pattern formed on the hole can be understood as z-axis (process 702).

Further, the method of fabricating a three-dimensional antenna apparatus according to an embodiment of the present invention may include patterning a predetermined antenna pattern by etching one side surface of the curved substrate and the other opposite side surface thereof (process 703).

The three-dimensional antenna apparatus according to an embodiment of the present invention can be sufficiently implemented only with usage of a curved-shaped printed circuit board (PCB) without separate cast of a mold, thereby to shorten the time for development lead, and reduce the fabrication expenses because using relatively simple processes such as patterning and drilling. Further, by employing the method of fabricating a three-dimensional antenna apparatus according to an embodiment of the present invention, processing failures caused in the process such as metallization or injection can be incredibly reduced because using relatively simple processes such as patterning and drilling.

Therefore, according to embodiments of the present invention for providing a three-dimensional antenna apparatus and a method of fabricating the same, the three-dimensional antenna apparatus can be implemented by using only a curved-shaped printed circuit board (PCB) without necessity of cast of a mold, and by using simple processes such as patterning and drilling, thereby reducing fabrication expenses and preventing processing failures occurred from metallization or injection.

The foregoing is illustrative of embodiments and is not to be construed as limiting thereof. Although a few embodiments have been described, those skilled in the art will readily appreciate that many modifications are possible without materially departing from the novel teachings and advantages. Accordingly, all such modifications and embodiments are intended to be included within the scope of this present invention as defined in the claims. In the claims, means-plus-function clauses are intended to cover the structures described herein as performing the recited function, and not only structural equivalents but also equivalent structures.

What is claimed is:

1. A three-dimensional antenna apparatus comprising:
a curved substrate curved in an arc shape;
a first antenna pattern formed on one side surface of the curved substrate, the first antenna pattern being aligned in the arc shape on the one side surface;
a second antenna pattern formed on the other side surface opposite to the one side surface of the curved substrate, the second antenna pattern being aligned in the arc shape on the other side surface; and
an antenna connection pattern penetrating the curved substrate and electrically connecting the first antenna pattern and the second antenna pattern.

2. The three-dimensional antenna apparatus as claimed in claim 1, wherein the first antenna pattern and the second antenna pattern are distanced apart from each other with a predetermined interval.

3. The three-dimensional antenna apparatus as claimed in claim 1, wherein the one surface and the other surface are curved in the arc shape along the first antenna pattern and the second antenna pattern, respectively.

4. The three-dimensional antenna apparatus as claimed in claim 1, wherein the curved substrate is a rigid substrate formed by a mold cast.

5. The three-dimensional antenna apparatus as claimed in claim 4, wherein the rigid substrate comprises at least one of FR4 and FRP.

6. The three-dimensional antenna apparatus as claimed in claim 1, further comprising an external element made of a conductive material, wherein the external element is electrically connected with at least one of the first antenna pattern and the second antenna pattern.

7. The three-dimensional antenna apparatus as claimed in claim 1, further comprising at least one of an inductor and a capacitor apparatus, wherein the at least one of the inductor and the capacitor apparatus is electrically connected with at least one of the first antenna pattern and the second antenna pattern.

8. The three-dimensional antenna apparatus as claimed in claim 1, further comprising a coupling unit for coupling the curved substrate and a housing of a portable terminal.

9. The three-dimensional antenna apparatus as claimed in claim 8, wherein the coupling unit comprises an embossing with a shape corresponding to an embossing formed on one side surface of the housing of the portable terminal, and the curved substrate and the housing of the portable terminal are coupled with each other by joining the embossing of the coupling unit and the embossing of the housing of the portable terminal.

10. The three-dimensional antenna apparatus as claimed in claim 8, wherein the coupling unit comprises an adhesive film, and the adhesive film couples the curved substrate and the housing of the portable terminal to each other.

11. The three-dimensional antenna apparatus as claimed in claim 8, wherein the coupling unit comprises a screw to penetrate the curved substrate and the housing of the portable terminal, and the curved substrate and the housing of the portable terminal are coupled with each other by the screw.

12. The three-dimensional antenna apparatus as claimed in claim 8, wherein the coupling unit couples the curved substrate and the housing of the portable terminal together by melt welding.

13. The three-dimensional antenna apparatus as claimed in claim 8, wherein the coupling unit couples the curved substrate and the housing of the portable terminal together by insert injection.

14. A method of fabricating a three-dimensional antenna apparatus comprising:

preparing a curved substrate being curved in an arc shape forming a hole in the curved substrate, wherein the hole penetrates the curved substrate from one side surface of the curved substrate to the other side surface opposite to the one side surface thereof;

applying a conductive material on the hole and the one side surface and the other side surface; and etching the one side surface to form a first antenna pattern and the other side surface to form a second antenna pattern being electrically connected with the first antenna pattern, the first antenna pattern and the second antenna pattern being aligned in the arc shape on the one surface and the other surface, respectively.

15. The method of fabricating a three-dimensional antenna apparatus as claimed in claim 14, wherein the conductive material applied to the hole forms a connection pattern, and the first antenna pattern and the second antenna pattern are electrically connected with each other by the connection pattern.

16. The method of fabricating a three-dimensional antenna apparatus as claimed in claim 14, further comprising: attaching or soldering an external element to at least one of the first antenna pattern and the second antenna pattern.

* * * * *